US007431357B2

(12) United States Patent
Pudney

(10) Patent No.: US 7,431,357 B2
(45) Date of Patent: Oct. 7, 2008

(54) EXTERIOR DOOR HANDLE WITH MINIMUM SURFACE INTRUSION

(75) Inventor: Richard I. Pudney, Plymouth, MI (US)

(73) Assignee: Key Plastics

( * ) Notice: Subject to any disclaimer, the term of this patent is extended or adjusted under 35 U.S.C. 154(b) by 73 days.

(21) Appl. No.: 10/974,201

(22) Filed: Oct. 27, 2004

(65) Prior Publication Data

US 2005/0093306 A1 May 5, 2005

Related U.S. Application Data

(60) Provisional application No. 60/516,805, filed on Nov. 3, 2003.

(51) Int. Cl.
*E05B 3/00* (2006.01)

(52) U.S. Cl. ..... 292/336.3

(58) Field of Classification Search ..... 292/336.3, 292/216, 347, 348, DIG. 22, DIG. 23, DIG. 38, 292/DIG. 65, 169, DIG. 61, 165, 1.5, 244; 70/237, 207, 107

See application file for complete search history.

(56) References Cited

U.S. PATENT DOCUMENTS 2,479,256 A * 8/1949 Radcliffe ..... 292/165
3,054,634 A * 9/1962 Westerdale ..... 292/336.3
4,883,296 A * 11/1989 Laurie ..... 292/336.3
4,886,310 A * 12/1989 Cyr et al. ..... 292/336.3
5,029,917 A * 7/1991 Szerlag et al. ..... 292/347
6,007,122 A * 12/1999 Linder et al. ..... 292/336.3
6,264,257 B1 7/2001 Meinke
6,363,577 B1 * 4/2002 Spitzley ..... 292/336.3
6,415,636 B1 * 7/2002 Fukumoto et al. ..... 70/208
6,594,861 B2 * 7/2003 Dimig et al. ..... 16/412
6,719,336 B2 * 4/2004 Sato ..... 292/336.3
7,152,893 B2 * 12/2006 Pudney ..... 292/336.3
2002/0059693 A1 5/2002 Jooss et al.
2002/0070567 A1 * 6/2002 Ciborowski et al. ..... 292/336.3
2003/0001399 A1 * 1/2003 Sato ..... 292/336.3
2007/0080547 A1 * 4/2007 Lee ..... 292/336.3

FOREIGN PATENT DOCUMENTS

FR 1 338 407 A 9/1963

* cited by examiner

*Primary Examiner*—Patricia Engle
*Assistant Examiner*—Kristina R Fulton
(74) *Attorney, Agent, or Firm*—David L. King

(57) ABSTRACT

An exterior door handle assembly (100) adapted to be secured to an exterior surface (24) of a vehicle door and when activated able to move a remotely located latch to an unlocked position, the door handle assembly comprising: a moveable first body member (102) and stationary second body member (140), a bell crank (160) movable with the first body member and adapted to be connected to the remotely located latch, the bell crank configured to rotate about an axis of rotation (200) located within the second body member (140) and which is exterior of the exterior surface of the door.

13 Claims, 4 Drawing Sheets

EXTERIOR DOOR HANDLE WITH MINIMUM SURFACE INTRUSION

This application claims the benefit of U.S. Provisional Application 60/516,805, filed on Nov. 3, 2003. The disclosure of the above application is incorporated herein by reference.

BACKGROUND AND SUMMARY OF THE INVENTION

The present invention is generally related to door handle and latch mechanisms for automotive doors and more particularly to a compact door handle assembly usable with thin vehicle doors and one that lessens the intrusion of handle parts through the exterior sheet metal or skin of the vehicle door into the inner volume of the door.

It is an object of the present invention to provide an exterior door handle assembly in which the axis of rotation of a bell crank is located outside of the sheet metal of the door. It is another object of the present invention to provide a door handle assembly that minimizes the intrusion of door handle parts through the outer skin of the door and into the interior space of the door.

Accordingly the invention comprises: an exterior door handle assembly adapted to be secured to an exterior surface of a vehicle door and when activated able to move a remotely located latch to an unlatched position, the door handle assembly comprising: a moveable first body member and stationary second body member, a bell crank movable with the first body member and adapted to be connected to the remotely located latch, the bell crank configured to rotate about an axis of rotation located within the second body member and which is exterior of the exterior surface of the door.

Many other objects and purposes of the invention will be clear from the following detailed description of the drawings.

DETAILED DESCRIPTION OF THE DRAWINGS

Figure 1:
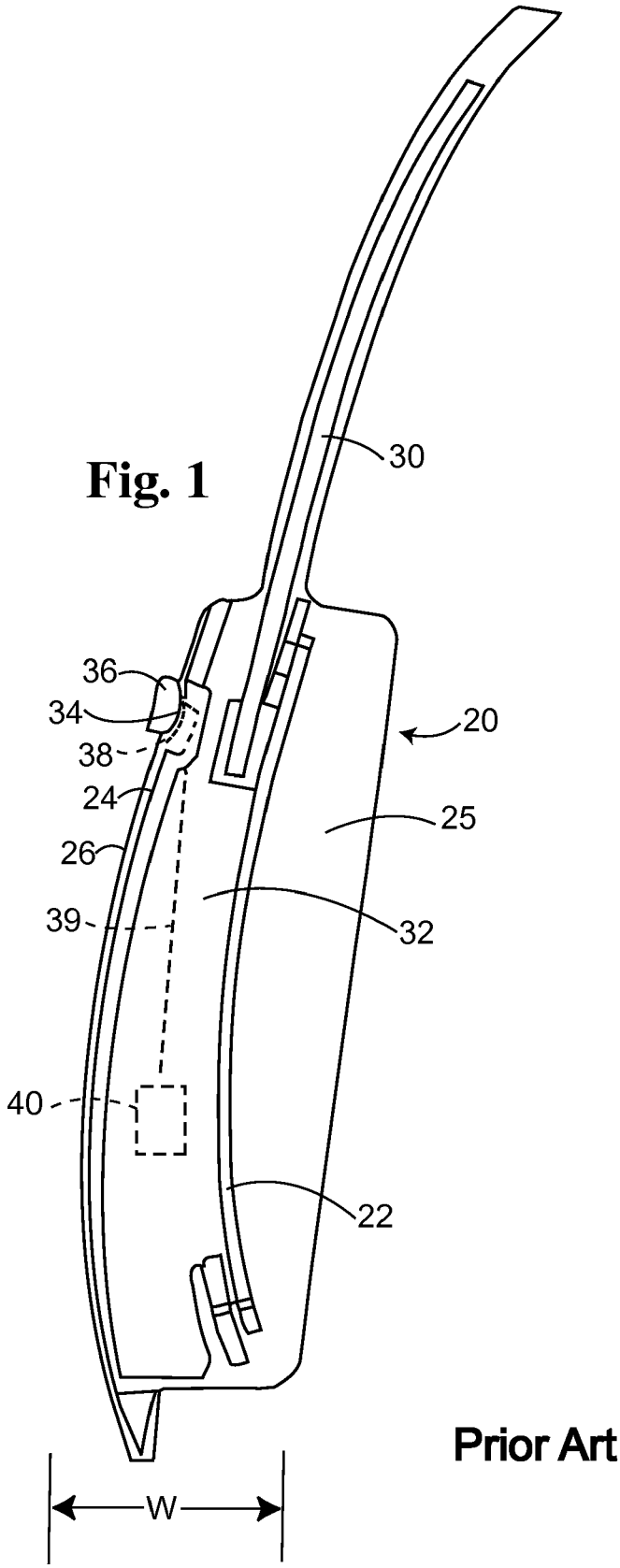
Fig. 1 Prior Art
FIG. 1 is an exploded view of a door handle assembly including the major components of the present invention.

FIG. 1 diagrammatically illustrates a cross-sectional view of a typical vehicle door 20. The door 20 includes an inner frame 22 and an outer frame 24, an interior door panel 25 attached to the inner frame 22, and exterior skin or sheet metal 26, which is attached to frame 24. The door 20 includes a window 30 (and related mechanism to support and move the window). The window is moveable within an interior space 32 of the door. Frame 24 and even the sheet metal 26 may be fabricated with a recess 34 proximate the location of a portion of the door handle 36 to make it easier to grab a certain handle. FIG. 1 shows a space or volume 32 demarcated by a phantom line and located within the door near the location of the handle 36; this space diagrammatically shows the intrusion of the related door handle parts into the interior space 32 of the door 20. These additional door handle parts 38 may include various mechanisms such as rotating bell cranks, hooks, cables and rods and attachment mechanisms, which permit the door handle to be operatively connected to a door latch or lock generally shown by numeral 40. As is known in the art, the door handle 36 may be connected to the latch or lock 40 by a flexible cable or a more rigid rod, which is shown by numeral 39.

Designers of the passenger compartment of the vehicle constantly strive to increase the dimensions of the passenger compartment. To achieve such an increase in the width of the passenger compartment one approach is to reduce the width W of each of the opposing doors 20 of the vehicle. As can be appreciated, this decrease in door width in essence moves the inner frame 22 and the inner panel 25 outwardly toward the outer frame, thereby reducing the space 32 available to receive the window and other mechanisms including motors and linkages. As this available interior space decreases, it may not be possible to use conventional door handle or window-related mechanisms in this smaller space. As mentioned above, the door handle 36 is linked to the door latch 40 by a rod or cable 39. The door handle is often connected to the cable or rod via a rotatable bell crank. Additionally, and as known in the art, the cable or rod must be moved a predetermined amount in order to cause the latch such as 40 to open. As can be appreciated, as the available space within the door is reduced there may not be sufficient room for a properly sized bell crank that can provide the necessary movement of the connecting cable or rod to open the latch.

Figure 2:
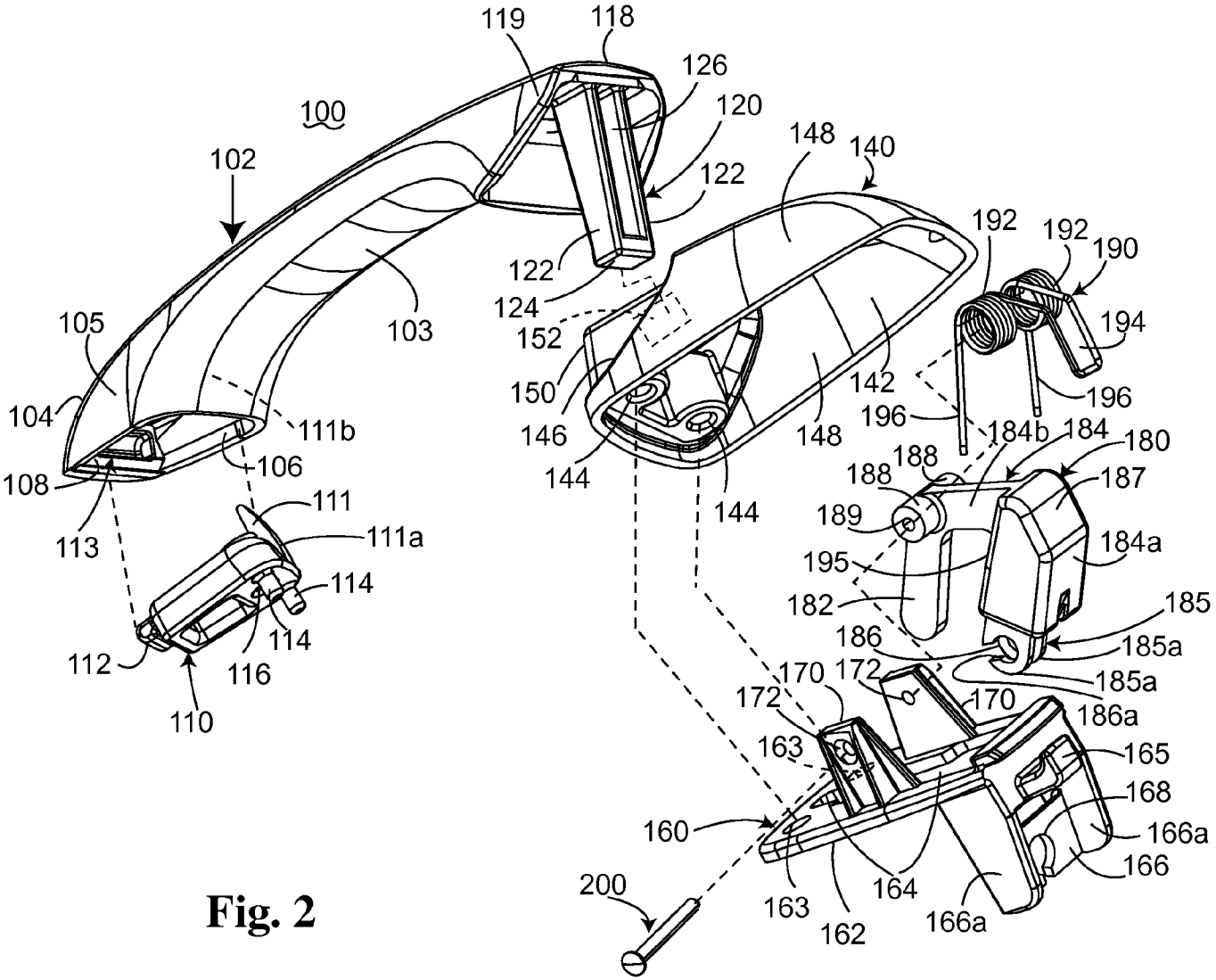
FIG. 2 is an assembly view of the present invention.
Figure 3:
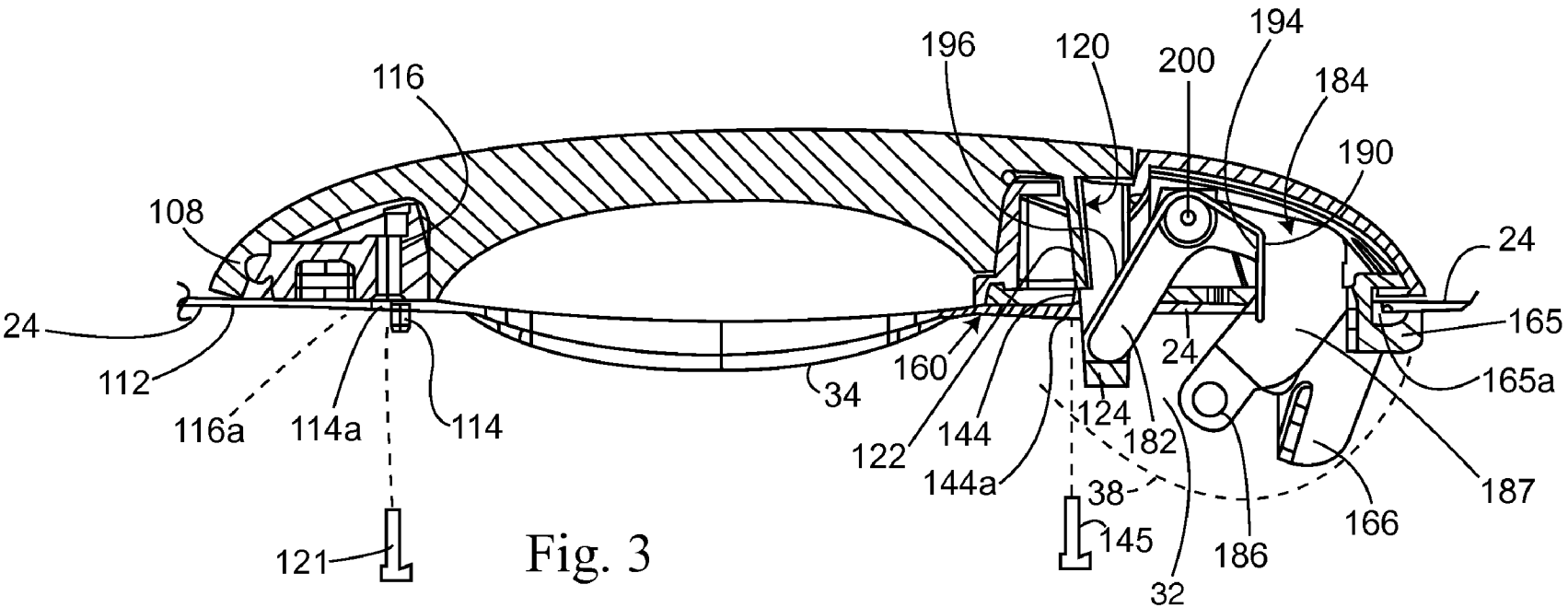
FIG. 3 is a cross-sectional view of an assembled door handle assembly.
Figure 4:
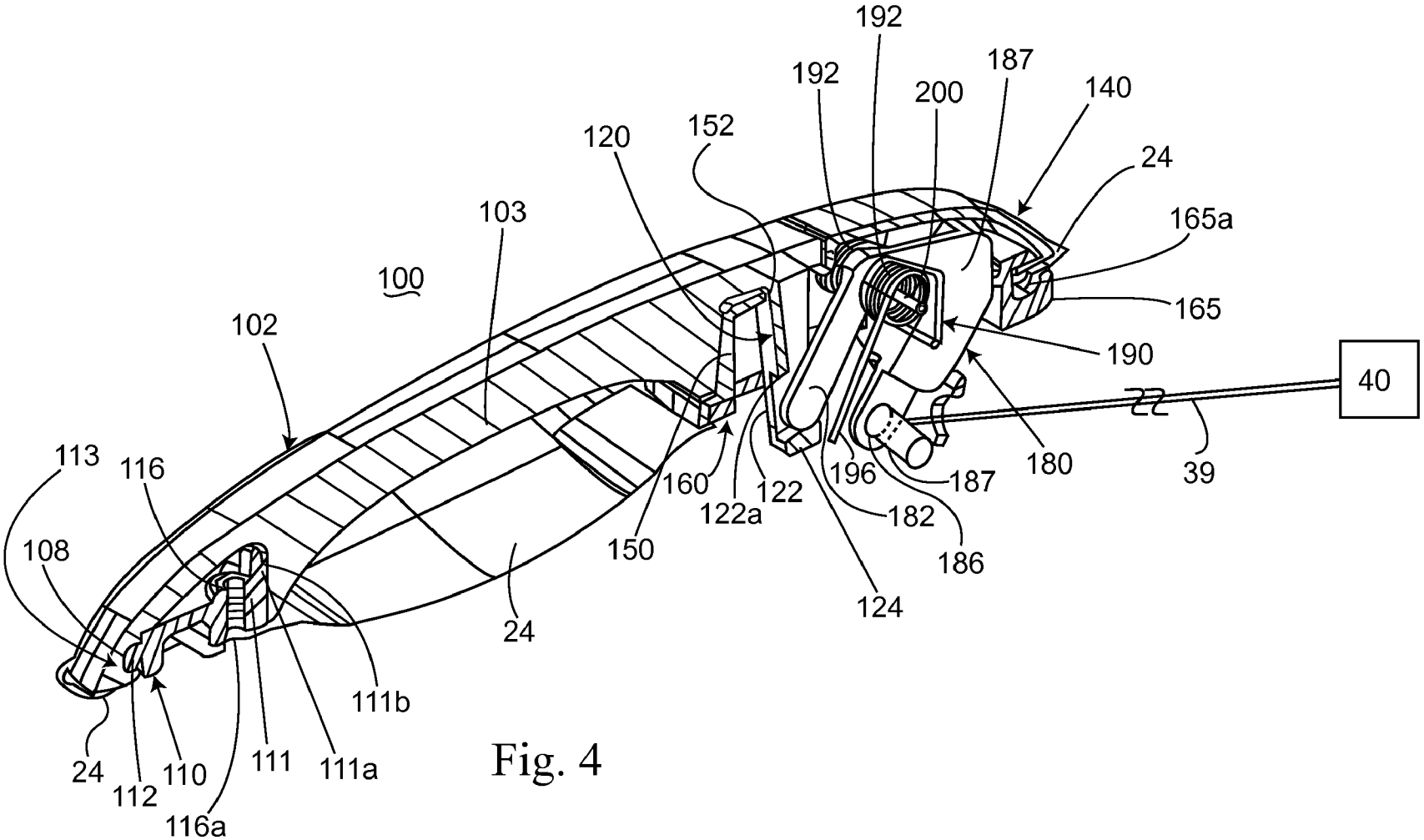
FIG. 4 is an oblique cross-sectional view of the door handle.

Reference is made to FIGS. 2-4, which illustrate a door handle assembly 100 of the present invention. The assembly 100 is adapted to be operatively secured to the exterior surface, sheet metal or skin 24 (and door frame) of a vehicle door such as 20.

The major components of the door handle assembly 100 are: a movable handle 102, a stationary cap 140, a pivot bracket 160 and a bell crank 180. The bell crank 180 is biased to a rest position by a bias spring 190 (the latch 40 may also include a spring that also biases the cable, which may permit the elimination of the spring 190) and movable to an activated position by the movable handle. In the embodiment illustrated, a pin 200 is received in holes 172 of the pivot bracket 160 and defines the rotational axis (also referred to as 200) about which the bell crank 180 rotates.

The cap 140, upon installation, is fixedly secured to the vehicle door. The cap 140 is dome shaped and defines a hollow cavity 142 therein. Positioned toward the rear of the cavity 142 is a plurality of threaded bosses or passages 144. The two sides 148 of the cap 140 include a profiled surface 146 near the rear upper end 150 of the cap. When the handle 102 is in its rest position a mating surface 119 of the handle 102 at end 118 overlaps and lies adjacent the profiled surface 146 at end 150 and provides an artistic transition therebetween. The rear of the cap 140 includes a walled member or end 150 defining an access opening 152 therein.

The handle 102 includes a center portion 103 configured to be manually grasped by the user of the door when the door is opened and moved. The handle 102 and cap are plastic molded parts generally of a glass reinforced nylon, or other engineered plastic material. The handle 102 has a rear end 104 with a tapered opening 106. A socket 108 is formed in an interior surface of an adjacent wall 105 of the handle 102, proximate the rear end of opening 106. The socket 108 includes a cylindrically shaped receiving or support surface that extends perpendicular to a longitudinal axis of the handle. The surface 108 in cooperation with a cylindrically shaped pin 112 of a connecting member 110 creates a pivot 113 about which the handle 102 moves. The connecting member 110, after assembly to the handle 102, is fixedly secured to the sheet metal 24 (as shown in FIG. 3). The connection member 110 additionally includes an upwardly extending leg 111. The exterior surface 111*a* of the leg 111 has a circular shape and slides against a mating surface 111*b* at the front of opening 106 of the handle (also shown in FIGS. 3 and 4). When the handle 102 is pulled away from the sheet metal or surface 24 of the vehicle, the handle 102 rotates about the pin 112 and slides relative to the surface 111*a*.

The connecting member additionally includes two thin extending pins 114, which extend outwardly and which are respectively received within mating opening 114*a* in the sheet metal (see FIG. 3). The openings 114*a* and pins 114 operate as an anti-rotation feature to properly align the connecting member 110 and to prevent the member 110 and hence the handle 102 from rotating. Additionally, the member 110 includes a threaded bore 116 through which a fastener 121 secures the connecting member 110 to the outer surface or sheet metal 24 of the door. The fastener 121 is received through an aligned opening 116*a* in the outer surface of the door.

Located at an opposite end 118 of handle 102 is an activation lever or lifting mechanism 120. As illustrated the lever or lifting mechanism 120 includes a plurality of sides 122 and a bottom 124, which define an opening 126. One of the sides 122 may include a notch 122*a*. A crank lever or arm 182 of the bell crank 180 is received in opening 126 and moved by bottom 124. This lever 182 functions as an activation lever. As can be appreciated the lever 120 need not always have a box-like construction; for example, if one of the sides 122 is removed, the lifting mechanism will resemble a hook having a single side 122 and a bottom 124, which is sufficient to engage the crank lever 182.

The bracket 160, bell crank 180, spring 190, and pin 200 are assembled into the cap 140. The bracket 160 includes a generally planar or flat portion 162 having mounting openings 163 at one end. The flat portion 162 additionally includes a central opening 164 through which the levers of the bell crank 180 swing. The opposite end of the flat portion 162 of the bracket includes an integrally formed hook 165. The hook 165 is received within a corresponding slot 165*a* formed in the exterior surface 24 of the door. With the hook in place the cap 140 and bracket 160 can be secured to the sheet metal 24 of the door 20. Positioned in front of the bracket hook 165 is a cable guide member 166 having a keyed opening or slot 168 for receipt of a cable 39. The cable guide member 166 elevates the cable apart from bell crank 180. As illustrated the guide member includes a plurality of sides 166*a* to reinforce the member 166.

The bracket 160 additionally includes two walls 170, which extend oppositely (toward the interior of the cap 140) from the direction of extension of the cable guide member 166. Each wall 170 includes the opening 172 into which pin 200 is received to provide an axis of rotation (also referred to by numeral 200) for the bell crank 180. The bell crank 180, as mentioned above, includes a first lever or arm 182 and as can be seen from the figures, also includes a second lever or arm 184 (a cable lever or arm), which terminates in a cable attachment connecting member or bracket 185. As illustrated, the cable attachment connecting members are formed as a double wall bracket. Each wall 185*a* includes an opening 186 to receive the cable termination (such as a cylindrically shaped ferrule 187 as shown in FIG. 4). One of the openings 186 includes an access opening 186*a* to facilitate placement of the cylindrical ferrule. As can be seen, the second lever, leg or arm 184 is bent (or curved) and includes a first leg portion 184*a*, which is situated parallel to leg 182. The first leg portion 184*a* supports an added mass 187, which helps prevent inadvertent unlatching of the door 20 during high acceleration side impact vehicular accidents. The mass 187 can be added to the lever 184*a* of the bell crank 180 or formed as an integral part thereof. The bell crank lever 184 also includes a second leg portion 184*b*, which connects leg 184*a* to the center of rotation of the bell crank. The bell crank includes oppositely directed stub axles 188 positioned on either side of legs 182 (or leg 184). A bore 189 (see FIG. 2) extends through the stub axles.

The bell crank 180 is positioned on bracket 160 so the bore 189 is colinear with openings 172; the pin 200 is inserted through openings 172 and bore 189. Spring 190 is positioned about the bell crank and connected to the bracket 160 to bias the bell crank toward its rest position as shown in FIGS. 3 and 4. The spring 190 biases the bell crank 180 in a counterclockwise manner about pin 200 (i.e. the axis of rotation) to apply a positive force on the cable. As illustrated, in the rest position, the activation arm 182 of the bell crank is moved away from the cavity of the cap 140. The spring 190 includes two coiled sections 192 and an extending spring arm 194 that is positioned in a biasing contact with a back surface 195 of the crank arm 184*a* (that is mass 187). The spring 190 includes two extending legs 196 that engage an adjacent part of the bracket 160 and secure the spring thereto. In the illustrated embodiment the rotational axis 200 is perpendicular to a longitudinal axis extending through the handle and cap. In an alternate embodiment of the invention the bracket 160 (and support walls 170) and orientation of the opening 152 of the lift mechanism are rotated 90 degrees. This permits the bell crank to rotate about an axis of rotation parallel to the longitudinal axis of the handle.

Prior to connecting the bracket 160, bell crank 180, spring 190 and pin 200 to the cap 140, the handle 102 is manipulated so that the lift mechanism 120 is inserted within opening 152 of the cap 140. After the bell crank is connected to the bracket 160, the bell crank 180 is manipulated so the activation lever 182 is inserted to operatively interfere with the lift mechanism; that is, it is placed within opening 126 of the lift mechanism 120. Thereafter the bracket 160 is positioned onto the bottom of the cap. Subsequently, the cap 140 is fixedly attached to the door 20 by the fasteners 145 received through openings 144*a* in the sheet metal 24 and threaded bores 144. Thereafter, the connecting member 110 is secured to the sheet metal or exterior surface or frame of the door.

When the center portion 103 of the handle is grasped and pulled outwardly, the handle 102 pivots about the pivot 113 provided by lower end 104 of the handle and the connecting member 110. The outward motion of end 118 of the handle 102 lifts the bottom 124 of lifting mechanism 120 against the activation lever (leg or arm) 182 of the bell crank, thereby urging the bell crank to rotate clockwise (into the cap) relative to the axis of rotation 200 against the bias force of the spring 190. This motion of the bell crank tensions the cable 39 leading to the latch 40, causing the door latch to unlatch.

When the handle is released the spring 190 operates on the bell crank 180 to return the bell crank and the door handle to their respective rest positions (shown in FIG. 2). As mentioned the latch 40 may also include a spring, which tensions the cable 39. As the bell crank moves to its rest position, i.e. rotates in a counterclockwise manner about axis 200, the leg 182 of the bell crank 180 urges the handle 102 back toward its rest position adjacent the outer surface of the vehicle.

Many changes and modifications in the above-described embodiment of the invention can, of course, be carried out without departing from the scope thereof. Accordingly, that scope is intended to be limited only by the scope of the appended claims.

The invention claimed is:

1. An exterior door handle assembly (100) which when activated is able to move a remotely located latch to an open position, the assembly (100) comprising:

a first and second body member (102,140) for attachment to an exterior surface of a vehicle door;

the first body member (102) being secured to the exterior of the vehicle door by a connecting member (110) and being positioned linearly adjacent to and movable relative to the second body member (140) from the rest position to an active position, the first body member having an end (118) including a depending lift mechanism (120), the depending lift mechanism (120) passes through an access opening (152) in an end (150) of the second body member (140) the end (118) of the first body member (102) overlapping the end (150) of the second body member in the rest position, the second body member having a hollow cavity (142);

a rotatable member which is a bell crank is operatively connected to the lifting mechanism at a first crank lever of the bell crank and movable therewith, the bell crank (180) is also connected to the remotely located latch via a connecting link, attached to a second crank lever of the bell crank, the bell crank is rotatable about a first axis, wherein the first axis is located in the hollow cavity and is exterior of the vehicle door and wherein the first crank lever and second crank lever extend through the hollow cavity of the second body member wherein the first and second body members lie along a first linear axis and wherein the axis of rotation of the bell crank is perpendicular to the first linear axis;

wherein the bell crank is generally U-shaped having the second crank lever (184) opposite the first crank lever (182) and wherein a counterweight is located between on or integral to a first leg portion (184*a*) of the second crank lever (184), the first leg portion (184*a*) being parallel to the first crank lever (182).

2. The assembly as defined in claim 1 wherein the rotatable member is spring loaded to move to a rest position.

3. The assembly as defined in claim 1 wherein the bell crank is operatively positioned relative to an engagement portion of the first body member, the bell crank being biased to a rest position.

4. The assembly as defined in claim 3 wherein the first body member is biased to a rest position by operation of the connection to the bell crank.

5. The assembly as defined in claim 1 further including a pivot bracket having two extending legs which support the rotatable member, each leg having an opening coincident with the first axis through which a pivot pin passes and secures the rotatable member there between within the hollow cavity.

6. An exterior door handle assembly (100) which when activated is able to move a remotely located latch to an open position, the assembly (100) comprising:

a first and second body member (102, 140) for attachment to an exterior of a vehicle door;

the first body member (102) being secured to the exterior of the vehicle door by a connecting member (110) and being positioned linearly adjacent to and movable relative to the second body member (140) from the rest position to an active position, the first body member having an end (118) including a depending lift mechanism (120), the depending lift mechanism (120) passes through an access opening (152) in an end (150) of the second body member (l40), the end (118) of the first body member (l02) overlapping the end (150) of the second body member (140) in the rest position, the second body member having a hollow cavity (142);

a rotatable member having a first lever arm (182) operatively connected to the lifting mechanism and movable therewith, the rotatable member having a second lever arm (184) connected to the remotely located latch via a connecting cable or link and the rotatable member is a bellcrank rotatable about a first axis, the first axis being located within the hollow cavity and exterior or the vehicle, the rotatable member being generally "U" shaped with the first lever arm (182) being parallel to the second lever arm (184) both the lever arms extending through the hollow cavity (142) wherein the first and second body members lie along a first linear axis and wherein the axis of rotation of the bell crank is perpendicular to the first linear axis;

further including a pivot bracket at least partially received within the hollow cavity including a support for rotatably supporting the rotatable member at the first axis.

7. The assembly as defined in claim 6 wherein the pivot bracket includes a cable guide member having an opening to slidingly receive a cable, one end of the cable secured and movable by the second crank lever.

8. An exterior door handle assembly (100) for a vehicle door and when activated able to move a remotely located latch to an open position, the assembly (100) comprising;

a first and second body member (102, 140) for attachment to an exterior surface of a vehicle door, the second body member, with the first body member in a rest position, aligned axially and linearly adjacent to the first body member, the first body member having an end that overlaps an end of the second body member in the rest position:

the first body member (102) configured to be movably secured relative to a vehicle door surface by a connecting member (110) and movable relative to the second body member (140) from the rest position to an active position, the first body member including a depending lift mechanism (120) extending through an access opening (152) in the overlapped end of the second body member and the vehicle door surface, the second body member adapted to be secured to the vehicle door surface and being adjacent the first body member, the second body member having a hollow cavity (142);

one rotatable member having a first crank lever operatively connected to the lifting mechanism and movable therewith, the rotatable member has a second crank lever directly connected to the remotely located latch via a connecting link, the rotatable member is rotatable about a first axis, wherein the first axis is exterior of the vehicle door surface and extends through the hollow cavity of the second body member; wherein the rotatable member is a bell crank wherein the first and second body members lie adjacent along a first linear axis each having an end that overlaps the other and wherein the axis of rotation of the bell crank is perpendicular to the first linear axis; and wherein the bell crank is generally U-shaped having the second crank lever parallel to the first crank lever and wherein a counterweight is located on or integral to the second crank lever.

9. The assembly as defined in claim 8 wherein the bell crank is operatively positioned relative to an engagement portion of the first body member, the bell crank being biased to a rest position.

10. The assembly as defined in claim 9 wherein the first body member is biased to a rest position by operation of the connection to the bell crank.

11. An exterior door handle assembly (100) when activated able to move a remotely located latch to an open position, the assembly (100) comprising:

a first and second body member (102, 140) for attachment to an exterior surface of a vehicle door, the second body member, with the first body member in a rest position, aligned axially and linearly adjacent to the first body member, the first body member having an end (118) and the second body member having an end (150), the end (118) of the first body member (102) and overlapping the end (150) of the second body member (140):

the first body member (102) configured to be movably secured relative to a vehicle door surface by a connecting member (110) and movable relative to the second body member (140) from the rest position to an active position, the first body member including a depending lift mechanism (120) at end (118) extending through an access opening (152) in the end (150) of the second body member (140) and the vehicle door surface, the second body member adapted to be secure to the vehicle door surface and being adjacent the first body member, the second body member having a hollow cavity (142); one generally "U" shaped rotatable member having a first crank lever operatively connected to the lifting mechanism and movable therewith, the rotatable member having a second crank lever directly connected to the remotely located latch via a connecting link, the rotatable member is rotatable about a first axis, wherein the first axis is exterior of the vehicle door surface and the first crank lever and second crank lever being parallel extends through the hollow cavity of the second body member and wherein the first and second body members lie adjacent along a first linear axis each having an end that overlaps the other and wherein the axis of rotation of the bell crank is perpendicular to the first linear axis;

further including a pivot bracket at least partially received within the hollow cavity including a support for rotatably supporting the rotatable member.

12. The assembly as defined in claim 11 further including the pivot bracket having two extending legs which support the rotatable member.

13. The assembly as defined in claim 11 wherein the pivot bracket includes a cable guide member having an opening to slidingly receive a cable, one end of the cable secured and movable by the second crank lever.

* * * * *